US006142473A

United States Patent [19]

Bryant

[11] Patent Number: 6,142,473

[45] Date of Patent: Nov. 7, 2000

[54] BASKETBALL BOARD GAME

[76] Inventor: Joe B. Bryant, 24663 Rensseler, Oak Park, Mich. 48237

[21] Appl. No.: 09/195,972

[22] Filed: Nov. 19, 1998

[51] Int. Cl.[7] ..... A63F 3/00

[52] U.S. Cl. ..... 273/244; 273/277; 273/259; 273/293; 273/287; 273/298

[58] Field of Search ..... 273/236, 242, 273/244, 259, 277, 287, 251, 252, 254

[56] References Cited

U.S. PATENT DOCUMENTS

| | | |
|---|---|---|
| 3,511,504 | 5/1970 | Mann . |
| 3,602,513 | 8/1971 | Breen . |
| 4,010,957 | 3/1977 | Tricoli . |
| 4,061,336 | 12/1977 | Lincoln . |
| 4,378,941 | 4/1983 | Derby . |
| 4,486,022 | 12/1984 | Dixon . |
| 5,123,653 | 6/1992 | Murphy . |
| 5,135,230 | 8/1992 | Denman . |
| 5,201,525 | 4/1993 | Castro . |
| 5,318,304 | 6/1994 | Reppas . |
| 5,318,306 | 6/1994 | Levin . |
| 5,664,780 | 9/1997 | Bricker . |
| 5,836,585 | 11/1998 | LaCivita . |

*Primary Examiner*—Jeanette Chapman
*Assistant Examiner*—Vishu Mendiratta

[57] ABSTRACT

A board game is provided including a plurality of transparent plastic sheets each mounted along a periphery thereof. Each transparent sheet is equipped with an edge being free from the game board to define an opening facing the central extent thereof. Also included is a plurality of basketball cards, a plurality of dice with numerals printed thereon, and a plurality of tokens. Next provided is a plurality of basketball trading cards each removably positioned within the opening of one of the sheets of the game board.

4 Claims, 3 Drawing Sheets

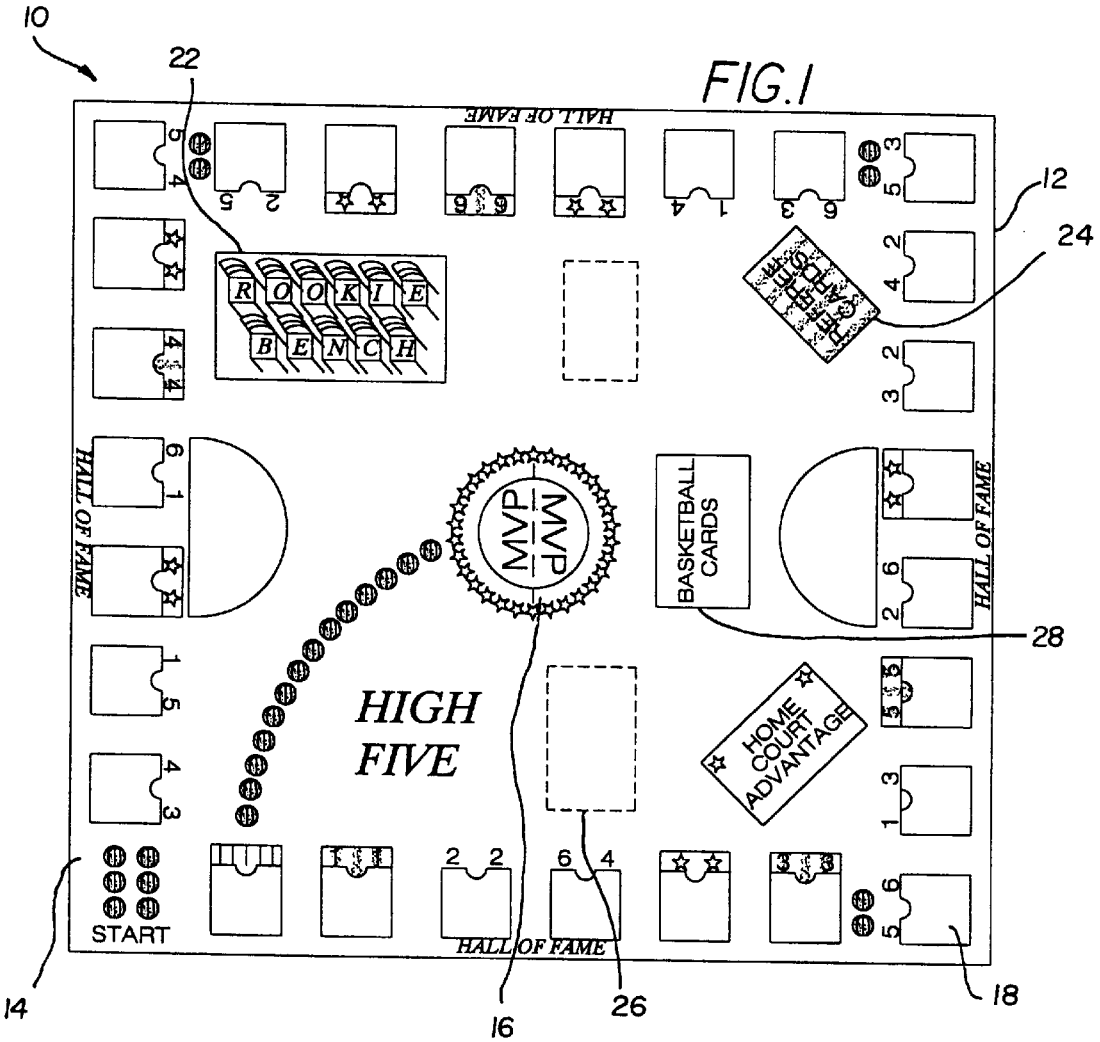
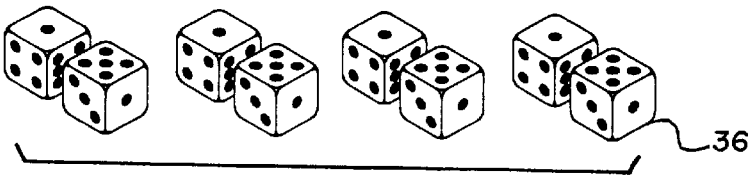
FIG.2

| HIGH FIVE WINNERS PAD | | | | |
|---|---|---|---|---|
| GAME | NAME | NAME | NAME | NAME |
| 1 | | | | |
| 2 | | | | |
| 3 | | | | |
| 4 | | | | |
| 5 | | | | |

42

FIG. 5

BASKETBALL BOARD GAME

BACKGROUND OF THE INVENTION

1. Field of the Invention

The present invention relates to board games and more particularly pertains to a new basketball board game for providing a basketball related board game adapted to be used with trading cards and which has a unique method of play.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 2,460,541; U.S. Pat. No. 2,611,615; U.S. Pat. No. Des. 256,813; U.S. Pat. No. 5,123,653; U.S. Pat. No. 4,486,022; and U.S. Pat. No. 5,221,091.

In these respects, the basketball board game according to the present invention substantially departs from the conventional concepts and designs of the prior art, and in so doing provides an apparatus primarily developed for the purpose of providing a basketball related board game adapted to be used with trading cards and which has a unique method of play.

SUMMARY OF THE INVENTION

In view of the foregoing disadvantages inherent in the known types of board games now present in the prior art, the present invention provides a new basketball board game construction wherein the same can be utilized for providing a basketball related board game adapted to be used with trading cards and which has a unique method of play.

The general purpose of the present invention, which will be described subsequently in greater detail, is to provide a new basketball board game apparatus and method which has many of the advantages of the board games mentioned heretofore and many novel features that result in a new basketball board game which is not anticipated, rendered obvious, suggested, or even implied by any of the prior art board games, either alone or in any combination thereof.

To attain this, the present invention generally comprises a game board having a square configuration with a top face, a bottom face and a periphery formed therebetween. As shown in FIG. 1, the top face has a start area positioned adjacent to a corner thereof. Associated therewith is a finish area positioned at a central extent of the game board. A plurality of transparent rectangular plastic sheets are each mounted along the periphery of the game board. Each sheet is equipped with an inboard edge which has a semicircular cut out formed therein. Such inboard edge is free from the game board to define an opening facing the central extent thereof. As an option, the game board has numeral indicia positioned thereon adjacent to the opening of each of the sheets. As such, each sheet represents a space. The game board further includes a "rookie bench" area, "referee" area, "home court advantage" area, and "basketball cards" area. A plurality of spaces indicate either the "referee" area or the "home court advantage" area. In the preferred embodiment, a background of the game board resembles a basketball court. Next provided is a plurality of basketball cards removably positioned in the "basketball cards" area on the game board.

Associated therewith is a plurality of referee cards removably positioned in the "referee" area on the game board. It should be noted that the referee cards each indicate instructions including: moving back a number of spaces, putting back a number of basketball cards, or moving to the "rookie bench" area of the game board. A plurality of home court advantage cards are removably positioned in the "home court advantage" area on the game board. The home court advantage cards each indicate instructions including: advancing a number of spaces or receiving a number of basketball cards. It should be noted that the home court advantage cards and referee cards each also include a message about an actual play of basketball. FIG. 2 shows a plurality of six sided dice with numerals printed thereon. FIG. 3 depicts a plurality of tokens each having a base with a unique basketball figurine mounted thereon. A plurality of basketball trading cards are each removably positioned within the opening of one of the sheets of the game board in a manner that will soon be set forth. The method playing the present board game will now be set forth. First, the dice are rolled in order to determine a player who takes a first turn. Next, the tokens are placed at the start area. Thereafter, turns are taken between the players, wherein each turn includes various steps including first rolling the dice. When the dice are rolled, the token is moved a number of adjacent spaces in a clockwise direction from the start area, wherein the number of adjacent spaces is equal to that indicated by the dice. A basketball card is collected upon rolling a predetermined numeral on the dice. During each turn, a player must pick one of the "referee" cards upon landing on one of the spaces of the game board that indicate the same. Similarly, the player must pick one of the "home court advantage" cards upon landing on one of the spaces of the game board that indicate the same. After picking such cards, the player must follow the instructions thereon. A player may only advance to the finish area only upon rolling a sufficient number on the dice in combination with having a greatest amount of basketball cards with respect to the remaining players. A winner is declared as the player who advances to the finish area first.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new basketball board game apparatus and method which has many of the advantages of the board games mentioned heretofore and many novel features that result in a new basketball board game which is not anticipated, rendered obvious, suggested, or even implied by any of the prior art board games, either alone or in any combination thereof.

It is another object of the present invention to provide a new basketball board game which may be easily and efficiently manufactured and marketed.

It is a further object of the present invention to provide a new basketball board game which is of a durable and reliable construction.

An even further object of the present invention is to provide a new basketball board game which is susceptible of a low cost of manufacture with regard to both materials and labor, and which accordingly is then susceptible of low prices of sale to the consuming public, thereby making such basketball board game economically available to the buying public.

Still yet another object of the present invention is to provide a new basketball board game which provides in the apparatuses and methods of the prior art some of the advantages thereof, while simultaneously overcoming some of the disadvantages normally associated therewith.

Still another object of the present invention is to provide a new basketball board game for providing a basketball related board game adapted to be used with trading cards and which has a unique method of play.

Even still another object of the present invention is to provide a new basketball board game that includes a plurality of transparent plastic sheets each mounted along a periphery thereof. Each transparent sheet is equipped with an edge being free from the game board to define an opening facing the central extent thereof. Also included is a plurality of basketball cards, a plurality of dice with numerals printed thereon, and a plurality of tokens. Next provided is a plurality of basketball trading cards each removably positioned within the opening of one of the sheets of the game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top view of a new basketball board game according to the present invention.

FIG. 2 is a perspective view of the dice of the present invention.

FIG. 5 is an illustration of a winner's score sheet of the present invention.

DESCRIPTION OF THE PREFERRED EMBODIMENT

Figure 3:
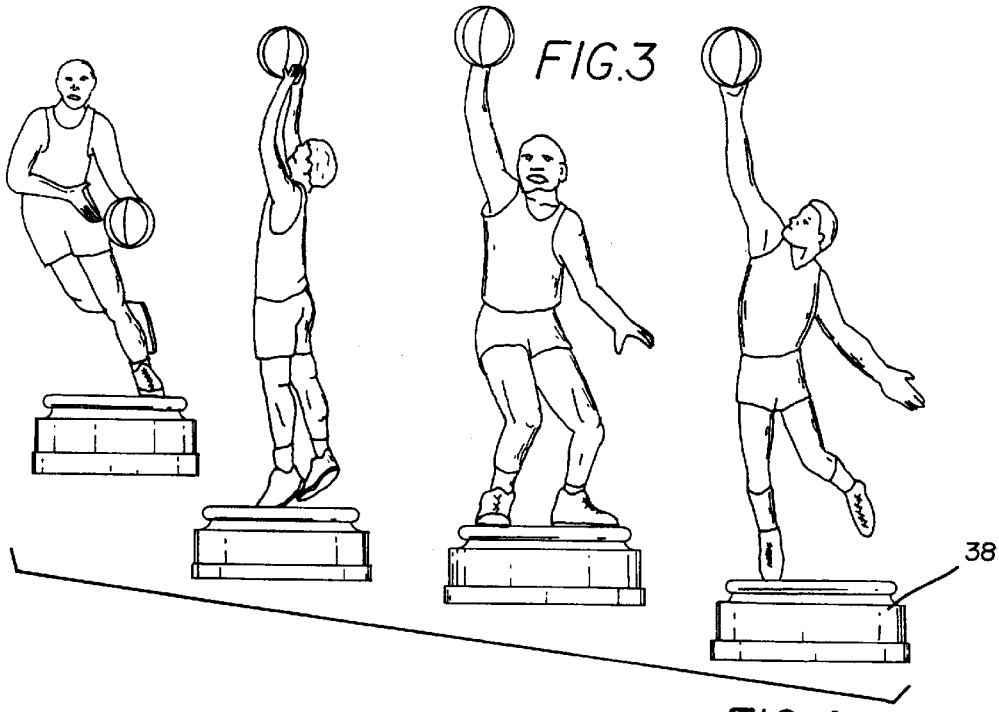
FIG. 3 is a perspective view of the tokens of the present invention.
Figure 4:
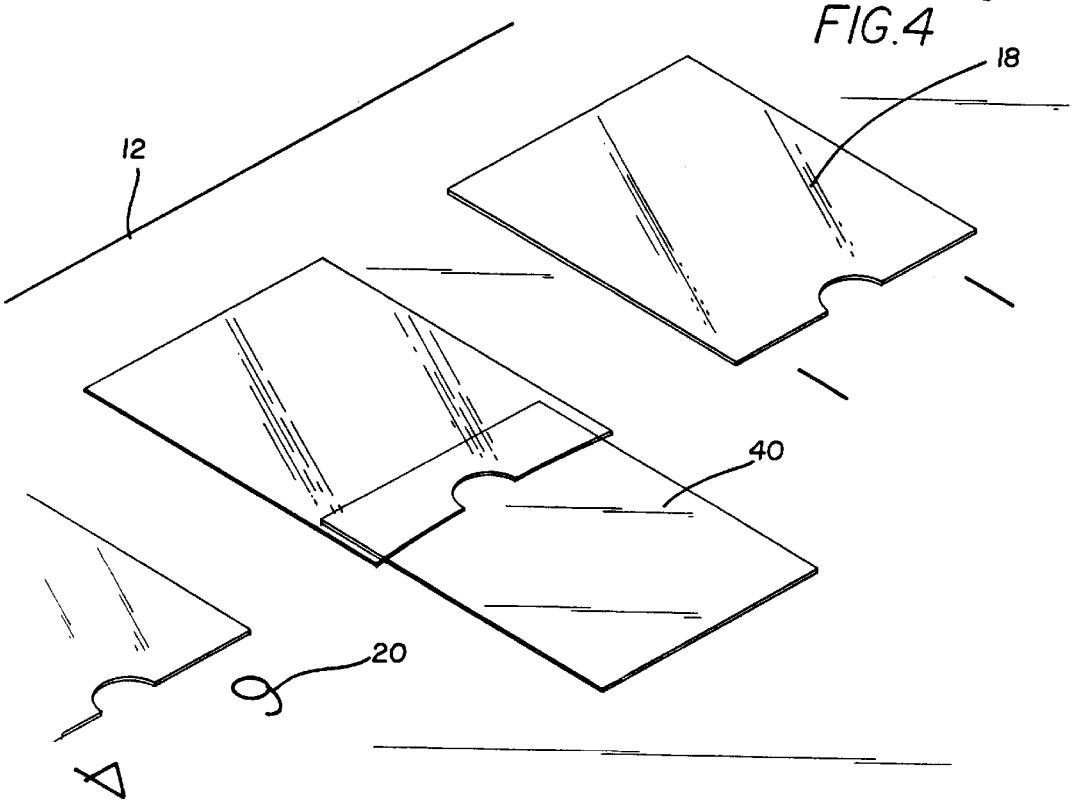
FIG. 4 is a perspective view of the transparent sheets of the present invention with the basketball trading cards removably received therein.

With reference now to the drawings, and in particular to FIGS. 1 through 5 thereof, a new basketball board game embodying the principles and concepts of the present invention and generally designated by the reference numeral 10 will be described.

The present invention, designated as numeral 10, includes a game board 12 having a square configuration with a top face, a bottom face and a periphery formed therebetween. As shown in FIG. 1, the top face has a start area 14 positioned adjacent to a corner thereof. Associated therewith is a finish area 16 positioned at a central extent of the game board.

A plurality of transparent rectangular plastic sheets 18 are each mounted along the periphery of the game board. Each sheet is equipped with an inboard edge which has a semicircular cut out formed therein. Such inboard edge is free from the game board to define an opening facing the central extent thereof. For reasons that will become apparent hereinafter, the game board has numeral indicia 20 positioned thereon adjacent to the opening of each of the sheets. Such numeral indicia preferably includes a pair of spaced numbers each representing a numeral 1–6. In use, each sheet is representative of a space of a path between the start area and the finish area.

The game board further includes a "rookie bench" area 22, "referee" area 24, "home court advantage" area 26, and "basketball cards" area 28. A plurality of spaces indicate either the "referee" area or the "home court advantage" area. In the preferred embodiment, a background of the game board resembles a basketball court.

Next provided is a plurality of basketball cards removably positioned in the "basketball cards" area on the game board. Associated therewith is a plurality of referee cards removably positioned in the "referee" area on the game board. It should be noted that the referee cards each indicate instructions including: moving back a number of spaces, putting back a number of basketball cards, or moving to the "rookie bench" area of the game board. A plurality of home court advantage cards are removably positioned in the "home court advantage" area on the game board. The home court advantage cards each indicate instructions including: advancing a number of spaces or receiving a number of basketball cards. It should be noted that the home court advantage cards and referee cards each also include a message about an actual play of basketball.

FIG. 2 shows a plurality of six sided dice 36 with numerals printed thereon. FIG. 3 depicts a plurality of tokens 38 each having a base with a unique basketball figurine mounted thereon. A plurality of conventional basketball trading cards 40 are each removably positioned in a random or otherwise manner within the opening of one of the sheets of the game board.

The method of playing the present board game will now be set forth. First, the dice are rolled in order to determine a player who takes a first turn. Ideally, each player has his or her own pair of dice during play. Next, the tokens are placed at the start area. Before play begins, each player must verbally select one of the spaces with a trading card therein as a "favorite" player.

Thereafter, turns are taken between the players, wherein each turn includes various steps including first rolling the dice. When the dice are rolled, the token is moved a number of adjacent spaces in a clockwise direction from the start area, wherein the number of adjacent spaces is equal to that indicated by the dice. A basketball card is collected upon rolling a predetermined numeral, preferably "5", on the dice. If two "5"'s are rolled, five basketball cards are collected. If regular double's are rolled, the player is afforded an extra turn.

During each turn, a player must pick one of the "referee" cards upon landing on one of the spaces of the game board that indicates the same. Similarly, the player must pick one of the "home court advantage" cards upon landing on one of the spaces of the game board that indicates the same. After picking such cards, the player must follow the instructions thereon. Further, if the "home court advantage" card is picked, an unillustrated timer is set during which time the player may continuously roll the dice and collect a basketball card for each "5" rolled.

If a referee card is picked and it indicates to go to the "rookie bench" area of the game board, the player must move his or her token thereto. During each subsequent turn, the player in the "rookie bench" area is required to roll the dice once and leave the "rookie bench" area only if doubles are rolled. It should be noted that no basketball cards are awarded for rolling "5"'s in this situation. If doubles are rolled, the dice are rolled again and the token is moved to the space corresponding to the numbers rolled. It should be noted that if a combination of numbers doesn't exist on the board, the player must roll again.

In an optional embodiment, a plurality of negative cards may be provided which indicate instructions including at least one negative card instructing a player to move back a number of spaces, at least one negative card instructing a player to move back a number of basketball cards, and at least one negative card instructing a player to move to a "rookie bench" area of the game board. A plurality of positive cards may be provided, with each positive card indicating instructions including at least one positive card instructing a player to advance a number of spaces and at least one positive card instructing a player to receive a number of basketball cards. Each turn includes the step of picking one of the negative cards upon landing on one of the spaces of the game board that indicates the same and subsequently following the instructions thereon. Each turn further include picking one of the positive cards upon landing on one of the spaces of the game board that indicates the same and subsequently following the instructions thereon.

It should be noted that if any of the player's tokens land on an opposing player's "favorite" player space, he or she must give up a basketball card to that player only if the opposing player remembers. This procedure may only take place after the player has passed the "favorite" player space the first time in the preferred embodiment.

A player may only advance to the finish area upon rolling a sufficient number on the dice in combination with having a greatest amount of basketball cards with respect to the remaining players. If a player rolls a sufficient number on the dice and does not have the most basketball cards, he or she must roll the pair of dice again and move to one of the spaces with the corresponding pair of numerals. A winner is declared as the player who advances to the finish area first. The winner may do a victory dance, high five the remaining players, or require the remaining players to do a victory dance for him or her per the desire of the winner. Ideally, a record of winners is kept on a winners pad shown in FIG. 5.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method playing a board game comprising the acts of:

providing a game board having a square configuration with a top face, a bottom face and a periphery formed therebetween, the top face having a start area positioned adjacent to a corner thereof, a finish area positioned at a central extent thereof, a plurality of transparent rectangular plastic sheets each mounted along the periphery of the game board with an inboard edge of each sheet being free from the game board to define an opening facing the central extent thereof for forming a pocket for receiving a card, each of the sheets having a semicircular cut out formed therein and for permitting a player to place a finger on a card located in the pocket and slide the card across the top face of the game board and out of the pocket, wherein the game board has numeral indicia positioned thereon adjacent to the opening of each of the sheets such that each sheet represents a space, the game board further including a "rookie bench" area, "referee" area, "home court advantage" area, and "basketball cards" area, wherein a plurality of spaces indicate at least one of the "referee" area and the "home court advantage" area;

providing a plurality of basketball cards removably positioned in the "basketball cards" area on the game board;

providing a plurality of referee cards removably positioned in the "referee" area on the game board, wherein the referee cards each indicate instructions including at least one instructing a player to move back a number of spaces, instructing a player to put back a number of basketball cards, and instructing a player to move to the "rookie bench" area of the game board;

providing a plurality of home court advantage cards removably positioned in the "home court advantage" area on the game board, wherein the home court advantage cards each indicate instructions including at least one instructing a player to advance a number of spaces and instructing a player to receive a number of basketball cards;

providing a plurality of six sided dice;

providing a plurality of tokens each having a base with a unique basketball player figurine mounted thereon;

providing a plurality of basketball trading cards each removably positioned within the pocket of one of the sheets of the game board;

rolling the dice in order to determine a player who takes a first turn;

placing the tokens at the start area;

taking turns between the players, wherein each turn includes the steps of:

rolling the dice, moving a number of adjacent spaces in a clockwise direction from the start area, wherein the number of adjacent spaces is equal to that indicated by the dice, wherein if each of the dice of the roll shows the same number, the player is afforded another turn, collecting a basketball card upon rolling a predetermined numeral on the dice, wherein the predetermined number is five, wherein if each dice of the roll shows a five, five cards are collected, picking one of the "referee" cards upon landing on one of the spaces of the game board that indicates the same and subsequently following the instructions thereon, picking one of the "home court advantage" cards upon landing on one of the spaces of the game board that indicates the same and subsequently following the instructions thereon, continuing to roll the dice for a period of time and collecting a basketball card for each five rolled until the period of time is over, and advancing to the finish area only upon rolling a sufficient number on the dice in combination with having a greatest amount of basketball cards with respect to the remaining players; and declaring a winner as the player who advances to the finish area first.

2. The method of claim 1 wherein a pair of dice from the plurality of dice is provided to each player.

3. A method playing a board game comprising the acts of:

providing a game board with a plurality of spaces;

providing a plurality of basketball cards;

providing a plurality of dice with numerals printed thereon;

providing a plurality of tokens;

taking turns between the players, wherein each turn includes the steps of:

rolling the dice, moving a number of adjacent spaces, wherein the number of adjacent spaces is equal to that indicated by the dice, wherein if each of the dice of the roll shows the same number, the player is afforded another turn, collecting a basketball card upon rolling a predetermined numeral on the dice, wherein the predetermined number is five, wherein if each dice of the roll shows a five, five cards are collected, picking one of the "referee" cards upon landing on one of the spaces of the game board that indicates the same and subsequently following the instructions thereon, picking one of the "home court advantage" cards upon landing on one of the spaces of the game board that indicates the same and subsequently following the instructions thereon, continuing to roll the dice for a period of time and collecting a basketball card for each five rolled until the period of time is over, and advancing to a finish area only upon rolling a sufficient number on the dice in combination with having a greatest amount of basketball cards with respect to the remaining players; and declaring a winner as the player who advances to the finish area first.

4. A method as set forth in claim 3 and further including the steps of providing a plurality of negative cards indicating instructions including at least one instructing a player to move back a number of spaces, instructing a player to move back a number of basketball cards, and instructing a player to move to a "rookie bench" area of the game board; providing a plurality of positive cards each indicating instructions including at least one instructing a player to advance a number of spaces and instructing a player to receive a number of basketball cards; wherein each turn includes the step of picking one of the negative cards upon landing on one of the spaces of the game board that indicates the same and subsequently following the instructions thereon and further picking one of the positive cards upon landing on one of the spaces of the game board that indicates the same and subsequently following the instructions thereon.

* * * * *